US005213369A

United States Patent [19]

Evans

[11] Patent Number: 5,213,369

[45] Date of Patent: May 25, 1993

[54] NOTEBOOK CONSTRUCTION

[76] Inventor: Monica Evans, P.O. Box 1246, New York, N.Y. 10011

[21] Appl. No.: 842,635

[22] Filed: Feb. 27, 1992

[51] Int. Cl.[5] ..... B42D 1/00

[52] U.S. Cl. ..... 281/21.1; 281/27

[58] Field of Search ..... 281/21.1, 27, 5, 12, 281/35, 36, 29, 27

[56] References Cited

U.S. PATENT DOCUMENTS

| | | | |
|---|---|---|---|
| 1,565,630 | 12/1925 | Egerton | 281/29 |
| 1,908,083 | 5/1933 | Tolchinsky | 281/21.1 |
| 1,973,375 | 9/1934 | Frazier | 281/21.1 X |
| 1,991,608 | 2/1935 | Frazier | 281/29 |
| 3,730,805 | 5/1973 | Heller, Jr. et al. | 281/27 X |
| 4,091,487 | 5/1978 | Axelrod | 281/21.1 |

*Primary Examiner*—Mark Rosenbaum
*Assistant Examiner*—Willmon Fridie, Jr.
*Attorney, Agent, or Firm*—Howard C. Miskin

[57] ABSTRACT

A notebook includes a cover member formed of flexible cardboard and having a medial flat spine and a pair of rectangular cover wing sections extending from the spine side edges. The body of the book includes several superimposed booklets with juxtaposed spines glued to the book spine, each of the booklets consisting of a stack of rectangular paper sheets joined along their medial longitudinal axis by a line of stitches. The sewn stack forming each booklet is folded along the longitudinal medial axis to form the respective booklet spine and the booklet pages.

6 Claims, 1 Drawing Sheet

NOTEBOOK CONSTRUCTION

BACKGROUND OF THE INVENTION

The present invention relates generally to improvements in books and it relates particularly to an improved notebook construction.

The binding constructions in conventional books, particularly notebooks, possess many drawbacks and disadvantages. They are costly and awkward, difficult to apply and of little versatility and adaptability. The resulting book is difficult and often impossible to fully open to a lie flat condition, the pages are often individually loosened and released from the binding, the binding is easily broken and the book otherwise leaves much to be desired.

BRIEF DESCRIPTION OF THE INVENTION

It is a principal object of the present invention to provide an improved book construction.

Another object of the present invention is to provide an improved notebook construction.

Still another object of the present invention is to provide an improved book binding construction.

A further object of the present invention is to provide an improved notebook construction which permits the fully open lie-flat condition of the book without the loosening or release of individual pages or damage to the binding.

Still a further object of the present invention is to provide an improved book of the above nature characterized by its simple and rugged construction, ease and convenience of use, low cost and great versatility and adaptability.

The above and other objects of the present invention will become apparent from a reading of the following description taken in conjunction with the accompanying drawing which illustrates a preferred embodiment thereof.

A book in accordance with the present invention comprises a cover member including a pair of laterally spaced rectangular cover sections separated by a longitudinal rectangular spine section joined at its side edges to respective proximate edges of the pair of cover sections and a stack of superimposed booklets each of which is formed of a stack of superimposed sheets, the sheets being mutually joined along a medial longitudinal axis of the stack and the stack being folded about its medial axis to form a spine having a rear outer face and a stack of superimposed pages. The booklet spines are proximately spaced and parallel and affixed to the inside face of the book spine.

The cover member is preferably formed of a single flexible cardboard sheet and, a medial pair of parallel transversely spaced fold lines are formed on the sheet to delineate the book spine section. The booklet sheets are sewn together at their medial longitudinal axis and the booklet spines of the stack of booklets are affixed to each other and to the book spine inside face by a suitable glue or cement.

The improved book is rugged, neat and compact, may be easily and efficiently produced and assembled in any desired size and is convenient to use, of attractive appearance and possesses a structure of great adaptability and versatility.

DESCRIPTION OF THE PREFERRED EMBODIMENT

Figure 1:
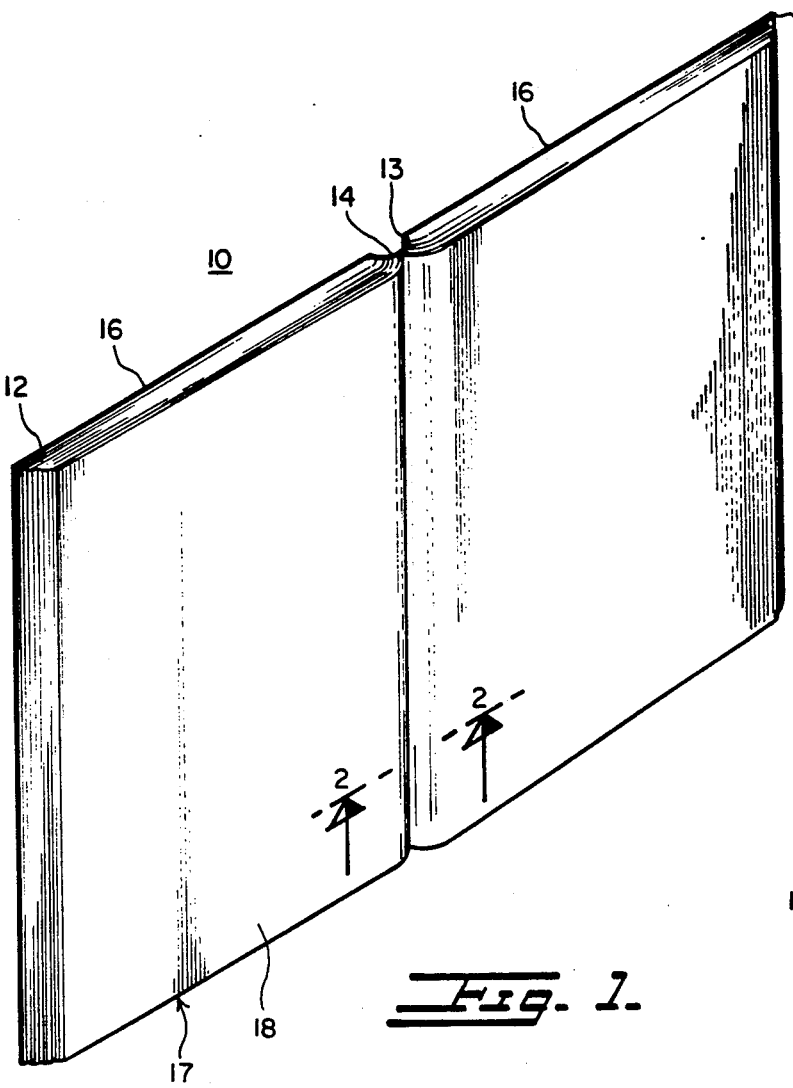
FIG. 1 is an inside perspective view of the improved book representing a preferred embodiment of the present invention and shown in a fully open position.
Figure 2:
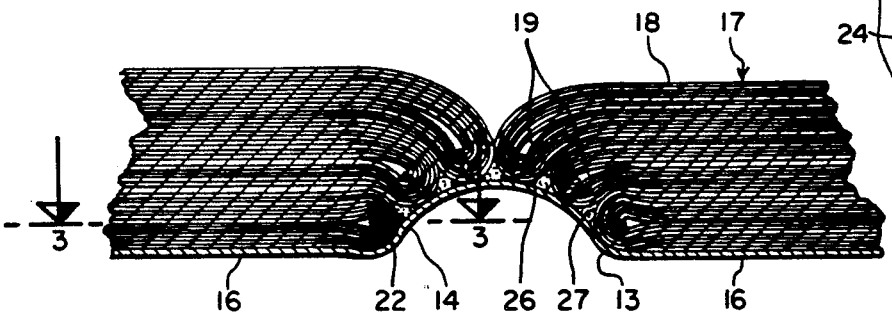
FIG. 2 is an enlarged sectional view taken along line 2—2 in FIG. 1.
Figure 3:
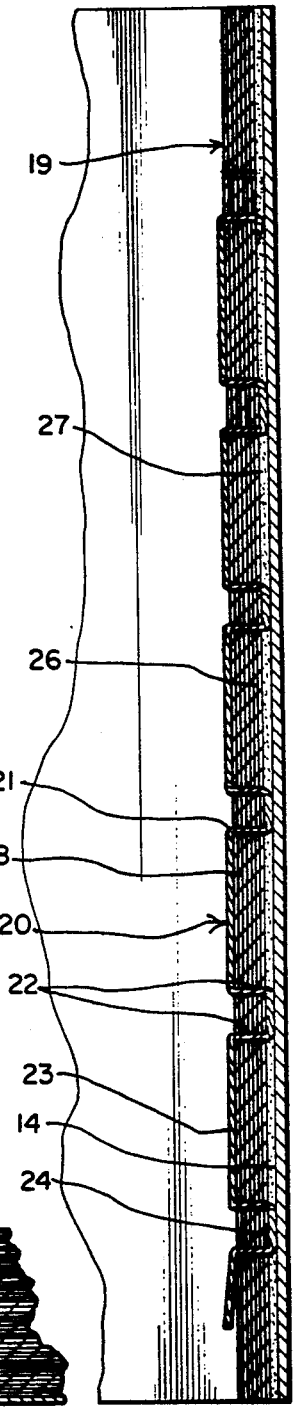
FIG. 3 is a sectional view taken along line 3—3 in FIG. 2.

Referring now to the drawings which illustrate a preferred embodiment of the present invention, the reference numeral 10 generally designates the improved book which includes a cover member 11 and a set or body 12 of pages embraced by cover member 11.

The cover member 11 is integrally formed of a sheet of flexible cardboard or other suitable flexible book cover material and is of rectangular configuration with the corners thereof rounded if desired. Impressed or otherwise formed in the cover member forming sheet is a pair of laterally spaced parallel longitudinal fold or hinge lines 13 which are symmetrical to the medial longitudinal axis of the flexible sheet. Hinge lines 13 delineate between them a book spine 14 and define the side edges of spine 14. Extending laterally outwardly from and longitudinally coextensive with the side edges of spine 14 are similarly shaped rectangular wing or cover sections or panels 16. The faces of spine 14 and cover panels 16 may be decorated as desired.

Affixed to book spine 14 in a manner hereinafter described is a set or body 17 of pages 18. The book body 17 comprises a plurality of similarly constructed and shaped booklets 19. Each booklet 19 is formed of a stack of superimposed rectangular paper sheets, the sheets being mutually firmly joined or sewn along their medial longitudinal axis by a line of stitches 20 of thread 21 of natural or synthetic fibers or filaments. The stitches include longitudinally spaced portions 22 traversing the sheet stack along its longitudinal axis and joined at opposite ends by longitudinally extending front and rear sections 23 and 24 respectively. The sewn stack of sheets is then folded about its medial longitudinal axis to form a respective booklet 19 of rectangular pages 18, each booklet having a booklet longitudinal medial rectangular spine 26. The pages 18 may be blank or lined or otherwise imprinted or decorated. Moreover, while sewing together the booklet page forming sheets is highly preferred, they may be otherwise joined as with staples or otherwise.

The booklets 19 are tightly stacked with the booklet spines 26 being juxtaposed. The stack of booklets 19 is affixed to the inside face of book spine 14 by means of a suitable glue or cement 27 between the confronting faces of the book spine 14 and the juxtaposed booklet spines 26. The glue 27 may be of any suitable type and may be set by heat or otherwise.

In the closed condition of book 10, the book cover sections 16 and pages 18 are parallel and highly compact with the book spine 14 being in a plane perpendicular to the book cover sections and pages. When the book 10 is in its fully open condition, the book cover sections 16 are coplanar so that the book 10 may firmly rest on the flat surface of a desk or table top with the topmost exposed pages 18 being horizontal.

While there has been described and illustrated a preferred embodiment of the present invention, it is apparent that numerous alterations, omissions and additions may be made without departing from the spirit thereof. For example, the outer corners of cover sections 16 and of pages 18 may be rounded.

I claim:

1. A notebook comprising a cover member including a pair of laterally spaced cover defining rectangular panels joined at their proximate sides by a longitudinally extending book spine section, a stack of a plurality of multipage booklets, each booklet including a stack of superimposed rectangular paper sheets mutually joined by threaded stitches along the medial longitudinal axes of said sheets, said stack of paper sheets being folded about said medial longitudinal axes to form pages and a booklet spine, the booklet spines of said stack of booklets being parallel and juxtaposed, and means affixing said booklet spines side-by-side to said book spine section.

2. The notebook of claim 1, wherein said cover panels and book spine section are integrally formed.

3. The notebook of claim 2 wherein said cover member is formed of flexible cardboard and said cover panels and book spine section are delineated by laterally spaced hinge lines.

4. The notebook of claim 1 wherein said spine affixing means includes an adhesive.

5. The notebook of claim 1 wherein said sheets have rounded outer corners.

6. The notebook of claim 1 wherein said sheets are blank or lined.

* * * * *